United States Patent [19]

Swenson

[11] Patent Number: 4,831,830

[45] Date of Patent: May 23, 1989

[54] FUEL-FIRED CHILLING SYSTEM

[75] Inventor: Paul F. Swenson, Shaker Heights, Ohio

[73] Assignee: Consolidated Natural Gas Service Company, Inc., Pittsburgh, Pa.

[21] Appl. No.: 104,353

[22] Filed: Oct. 2, 1987

[51] Int. Cl.[4] ..... F25D 3/00

[52] U.S. Cl. ..... 62/59; 62/323.1

[58] Field of Search ..... 62/59, 323.1

[56] References Cited

U.S. PATENT DOCUMENTS

| | | | |
|---|---|---|---|
| 1,863,750 | 6/1932 | King | 62/59 X |
| 1,969,187 | 8/1934 | Schutt | 62/59 X |
| 2,185,515 | 1/1940 | Neeson | 62/59 X |
| 2,737,027 | 3/1956 | Kleist | 62/59 X |
| 3,247,679 | 4/1966 | Neckler | 62/271 |
| 3,653,221 | 4/1972 | Angus | 62/59 |
| 4,513,574 | 4/1985 | Humphreys et al. | 62/59 |

*Primary Examiner*—William E. Tapolcai

*Attorney, Agent, or Firm*—Pearne, Gordon, McCoy & Granger

[57] ABSTRACT

A chiller system for satisfying a cyclical cooling load including a fuel-fired prime mover and compressor set and a cold storage bank. The prime mover compressor set is sized for efficient, substantially continuous operation from cycle to cycle and the cold storage is sized to provide any short term deficiency of cooling rate in the prime mover compressor set. The prime mover compressor set is preferably operated during periods of cooling demand and is modulated in output capacity to extend real time matching of cooling delivery rate and consumption. A condenser reset temperature feature takes advantage of cyclic changes in operation to improve efficiency.

7 Claims, 1 Drawing Sheet

FUEL-FIRED CHILLING SYSTEM

BACKGROUND OF THE INVENTION

The invention relates to apparatus and a method for supplying cooling energy in applications where the cooling load is cyclical.

PRIOR ART

Air conditioning, i.e. space cooling, is a common example of a cooling load which varies with time. Normally, the cooling load for air conditioning cycles on a daily basis. When the air conditioning equipment is powered by utility supplied electrical power, the periodically billed utility demand charge assessed the user, typically, can be greatly increased. This often results where operation of such equipment coincides with the peaking of other electrical demands at the site being air conditioned normally during working hours.

To reduce total peak electrical demand, it is known to "time shift" the production of cooling energy to periods such as nighttime when other electrical loads are at a low level. This cooling energy is stored typically in an ice bank and used later as required. Such a solution is imperfect because the production of ice can require roughly 20% more energy, for a given amount of air conditioning capacity, than is required to supply such capacity on a real time, i.e. as used, basis. Moreover, since operation of the electrical air conditioning unit incurs the maximum demand charge at times of high demand of other appliances, it is often an economic necessity to discontinue its operation during such periods and it cannot therefore be fully downsized to a minimum for greatest savings in capital investment.

U.S. Pat. No. 4,565,069 to MacCracken discloses a system in which air conditioning capacity is derived through an absorption cycle, heat for the absorption cycle being supplied from that rejected from an internal combustion engine. Generally, the initial cost of absorption cycle systems is relatively high and, consequently, such systems have not been widely commercially accepted.

SUMMARY OF THE INVENTION

The invention provides a fuel-fired refrigeration compressor system for meeting cyclical cooling loads, such as air conditioning, where the production of cooling energy may be spread over a time substantially greater than the duration of the load so as to reduce the size and therefore the capital costs of the refrigeration components. Cooling energy produced prior to the occurrence of the load is stored in an ice bank or other cold storage medium. Preferably, where the load occurs for a substantial period, e.g. a significant part of a day, the system is caused to operate through such period so that cooling energy is supplied simultaneously from the refrigeration compressor and from the ice bank. This mode of operation improves efficiency by avoiding expenditure of the energy required to reach freezing temperatures for that part of the cooling energy produced as it is being used. Additionally, generation of cooling energy through the duration of the load allows the system to be fully downsized for greater savings in capital costs.

The fuel-fired prime mover operating the compressor can be an internal combustion engine, a stream or gas turbine, or a Stirling engine, for example. In accordance with one aspect of the invention, the speed of the prime mover is controlled to modulate the output of the compressor so that as much of the cooling load as possible can be met directly on a real time basis with the prime mover and refrigeration compressor fully loaded in order to maximize efficiency of operation.

In accordance with another aspect of the invention, the heat rejected by the prime mover is used at a site where there is need for hot water or low pressure stream. The engine is operated at times when heat is required and the shaft power of the engine is stored as cold energy in the ice bank. The engine can be fitted with an electrical generator so that when the requirement for cold energy storage has been met, engine operation and heat generation can continue in response to the heat load while electrical energy is simultaneously produced. In some installations it can be beneficial to operate a generator, with cold storage requirements satisfied, without utilization of heat rejected by the engine. For example, the generator can be moved to shave peak electrical demands supplied by a utility to reduce electrical charges to the user.

In accordance with still another aspect of the invention, where the cooling load occurs primarily during the daytime, such as in air conditioning, nighttime ambient temperatures are characteristically substantially lower than daytime temperatures and refrigeration heat is transferred to the atmosphere, the condenser operating temperature is reset to a lower value at night. Since the ambient temperature is lower at night, sufficient heat transfer is achieved at the condenser despite the lowered operating temperature. With the lower operating temperature at the condenser, less energy is required to produce a given quantity of stored cooling capacity. With temperature reset of the condenser, the penalty for making ice, because of the relatively low temperature of the ice as compared to the temperature of brine used in real time cooling, is substantially eliminated.

The disclosed fuel-fired refrigeration system takes advantage of the relatively low cost, reliability and safety inherent in the use of an ice bank for energy storage. A downsized fuel-fired refrigeration compressor, used with an ice bank of relatively low cost, in accordance with the invention, allows such refrigeration equipment to be competitive on an initial cost basis with electrically operated equipment. The fuel-fired refrigeration system of the invention when operating on natural gas is significantly less expensive to operate on a cost of fuel basis, than are known electrically operated systems on a cost of electricity basis. The cooling load time spreading effect afforded by the invention is applicable to other processes, besides air conditioning, such as industrial processes involving chemical reactions, melting or freezing as well as cooking operations.

DESCRIPTION OF THE PREFERRED EMBODIMENT

Figure 1:
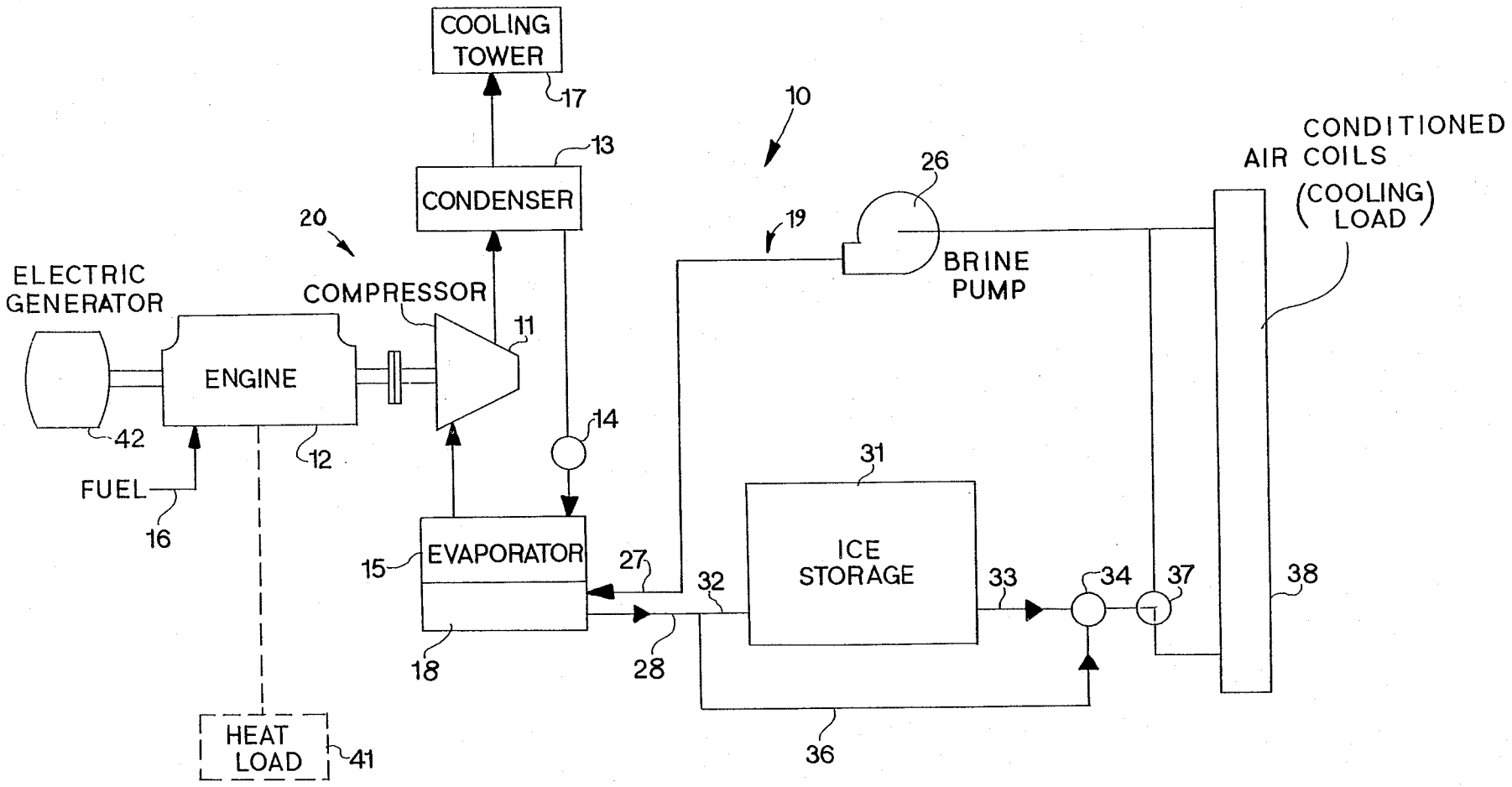
FIG. 1 is a diagrammatic representation of an air conditioning circuit embodying the invention.

Referring now to the drawing, there is schematically illustrated a chiller circuit 10 used, for example, to provide air conditioning, i.e. space cooling, in an enclosed zone of a building or the like at which the circuit is installed. In the illustrated embodiment, the chiller circuit 10 includes a brine section 19. The chiller circuit also includes a refrigeration section 20 comprising a compressor 11 powered by a fuel-fired prime mover 12 as well as a condenser 13 and an evaporator 15.

The refrigeration circuit operates in a generally conventional manner. The compressor 11 using a fluorocarbon such as Freon or other suitable refrigerant supplies high-pressure vapor to a condenser 13. The refrigerant gives up heat in the condenser and is condensed to a liquid state and passes then to an expansion valve 14 where it partially evaporates and is cooled and then flows into an evaporator 15. The refrigerant completes evaporation and absorbs heat in the evaporator 15 (from the brine circuit 19 by means of heat transfer) and then the vapor is sucked into the compressor to repeat the compression and expansion cycle.

The prime mover 12 can be an internal combustion engine, a turbine, or a Stirling engine, for example. The prime mover or engine 12 is supplied with a combustible fuel such as natural gas through a line 16.

The condenser 13, when used in an air conditioning system, transfers heat to the earth's atmosphere either directly by circulation and contact with air, or through a cooling tower 17 in a known manner. The evaporator 15 includes heat exchanger means 18 through which brine, in the form of ethylene glycol or other suitable liquid, circulates to give up heat to the refrigerant in the evaporator. The brine is circulated through the heat exchanger means 18 by a pump 26 through lines 27, 28.

A cold storage tank or bank 31 preferably containing water and/or ice is chilled by brine from the evaporator 15 through a line 32. Brine which has chilled or is chilled by the ice in the tank 31 is carried in a line 33 to a mixing valve 34. Another line 36 bypasses the tank 31 to carry brine from the evaporator 15 to the mixing valve 34. Brine from the mixing valve 34 passes through a two-position three-way valve 37 either to the coils of a heat exchanger 38 in an air duct or directly to the inlet of the brine pump 26, depending on its position. The valve 37 is illustrated in an air conditioning mode where the brine passes through the coils 38. These air duct coils 38 represent the cooling load served by the circuit 10. A fan, not shown, forces air across the air duct coils 38 thereby allowing such air to be cooled and recirculated through the building space or zone being air conditioned.

Typically, air conditioning of an occupied building represents a cyclic cooling load with the greatest demand for cooling energy occurring in the afternoon period and the minimum demand occurring in the nighttime period. A high air conditioning load may exist for 8 to 12 hours, for instance, and a nominal or non-existent load will exist for the remainder of a 24-hour day. The ice-storage bank 31 is sized such that it can store and supply the cooling capacity required to cool the air conditioned zone serviced by the coils during the period of highest cooling load in a design day, less any cooling created by operation of the compressor 11 during such period. The compressor 11, in conjunction with the evaporator 15 and condenser 13, is sized to produce the total cooling energy required throughout the 24-hour period of a cooling design day. By operating the prime mover and compressor set continuously throughout a 24-hour period of a design day, its size can be reduced substantially to a minimum while still meeting the cooling requirements of the site.

Whenever there is a demand for cooling energy, it is preferable that the compressor produce such energy contemporaneously with the demand, i.e. on a real time basis, to the extent of its capacity. This simultaneous production of cooling energy is ordinarily more efficient in fuel energy consumption since, in this mode, the evaporator 15 can operate with temperatures near chilled brine temperatures of, for example 44° F. rather than below freezing temperatures, e.g. 26° F. Since the refrigerant temperature differential between the evaporator and the condenser is reduced, approximately 20% less fuel energy is required to move heat from the evaporator to the condenser.

The mixing valve 34 is normally operated to supply chilled brine exclusively from the evaporator 15 during operation of the compressor 11 through the line 36 when the compressor 11 is capable of fulfilling the current demand. In accordance with an important aspect of the invention, the speed of the engine 12 is modulated to match the output of the compressor to the contemporaneous cooling load. In the illustrated case, the compressor 11 is a constant volume per revolution device and is directly driven by the shaft of the engine 12. Where the prime mover 12 is an internal combustion engine, for example, it can be efficiently run through a speed range of approximately 2 to 1 or more. When the cooling load is relatively light, the engine 12 is driven at relatively low speed. Conversely, when the cooling load is moderate, the engine is run at a higher speed to cause greater power through the compressor 11 to deliver greater cooling capacity. Below a speed at which the engine and compressor efficiency is greatly diminished, the compressor operation is discontinued and the cooling load can be met by full reliance on energy stored in the ice bank 31. In this latter circumstance, the mixing valve 34 allows the pump 26 to circulate sufficient brine through the ice bank and coil 38 to meet the demand. When the cooling demand exceeds the rated output of the compressor 11, the mixing valve supplements its output energy being carried in line 36 with cooling energy in the ice bank transferred through the line 33.

When the cooling energy stored in the ice bank 31 is below a predetermined value, the diverting valve 37 is moved from the illustrated position to its alternative position and the compressor 11 is operated to recharge it by causing a phase-change of water to ice in the storage bank. As previously indicated, when making ice, the evaporator 15 operates with a brine temperature in the chamber 18 of approximately 26° F.

When producing cooling energy directly to the air coil 38 (bypassing the ice storage 31 through the line 36) on a real time basis, the evaporator chamber 18 operates at a temperature of, for example, 44° F. In accordance with another important aspect of the invention, when the compressor 11 is operated at nighttime to replenish the cooling capacity stored in the bank 31, the operating pressure of the condenser 13 can be reset to a relatively lower pressure and a correspondingly lower temperature by conventional control methods to take advantage of the ordinarily lower nighttime outdoor air temperature to which the cooling tower 17 (or the condenser 13 when no cooling tower is used) is exposed. Operation of the compressor 11 with this reduced condenser temperature (a drop of, for example, 25° F. from a daytime temperature of 90° F. with a cooling tower or from a daytime temperature of 125° F. with a dry air cooled condenser) improves fuel efficiency of the prime mover compressor since less energy is required to transfer heat between the evaporator and condenser. The amount of power required to operate the compressor on a per ton of refrigeration capacity basis increases as the compressor discharge pressure increases. Since the temperature at the condenser 13 is decreased, the pressure is likewise decreased.

It will be noted that since the evaporator is held at a relatively cold temperature, for example 26° F., during ice-making, a sufficient temperature and pressure differential will exist between the evaporator and condenser so that proper functioning of the refrigerant expansion valve 14 is ensured. During the ice-making mode at nighttime, compressor suction (inlet) pressure is substantially reduced due to a depressed evaporator temperature relative to the evaporator temperature that exists during the chilled water mode when the compressor is contributing directly to the air conditioning load. Evaporator temperature/pressure can be controlled by monitoring the compressor discharge pressure and regulating heat exchange from the condenser such as by the control of the fans serving the cooling tower or evaporator.

During daytime hours, the temperature of the condenser can be reset to a higher temperature when the compressor 11 is operated.

Rejected heat from the fuel-fired prime mover 12 such as water jacket and exhaust heat of an internal combustion engine can be used for a heat load diagrammatically indicated at 41. A heat load, in the form of a supply of hot water or low pressure steam is found, for example, in commercial and industrial applications such as in restaurants, canneries, and chemical processing plants. The prime mover 12 can be operated to supply rejected heat through an appropriate medium to the load 41 on a real time basis and the shaft power of the prime mover 12 operating the compressor 11 can be stored in the form of refrigeration in the ice bank for subsequent use. Cogeneration of heat energy and cooling capacity affords dramatic savings in energy costs to the user. Whenever substantial amounts of the rejected heat of the primer mover 12 can be used on a real time basis, the prime mover can be operated to build a store of cooling capacity in the ice bank 31. The preference of generating cooling energy on a real time basis, if heating and cooling loads are not contemporaneous, can be ignored since a 20% penalty in efficiency to use ice storage is more than offset by the heat energy gain.

An electrical generator 42 can be selectively coupled to the shaft of the prime mover 12 by a positive drive clutch. Normally, the prime mover drives either the compressor 11 or the generator 42, but not both. When the circuit 10 is used in a climate where refrigeration-based air-conditioning is not required year round, for example, certain applications may warrant the provision of the generator 42 and its attendant controls for supplying on-site electrical energy needs or for interconnection with an electrical utility.

Besides the disclosed air-conditioning application, other industrial and commercial applications exist which can be benefited by a refrigeration circuit which operates essentially the same as that described hereinabove. While the illustrated embodiment utilizes a brine circuit to transfer heat between the evaporator 15 and cold storage bank 31, the invention is applicable to other systems without brine circuits, such as where the evaporator is in direct heat transfer relation with the cold storage medium. Examples of such systems include ice-making apparatus where ice is formed directly on the evaporator and, periodically, is mechanically removed or is thermally removed in a defrost-type cycle.

The circuit 10 is particularly suited for application where the cooling load exhibits cyclic peaks and the cold storage bank can supply a substantial portion of the energy required in a peak cycle. A measure of a "peak" characteristic of an application can be expressed in terms of design cooling load divided by installed mechanical refrigeration capacity of the prime mover compressor set. A typical ratio, by way of example, is 1.6:1 with some situations exceeding 2:0:1. Where there is need for both cooling and heating capacity, the disclosed circuit and method are of particular advantage.

While the invention has been shown and described with respect to a particular embodiment thereof, this is for purposes of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

I claim:

1. A method of meeting a cyclic cooling load that exhibits peak cooling load characteristics which comprises providing a fuel-fired prime mover and refrigeration compressor set in a refrigeration circuit connected to a cold storage bank, sizing the prime mover compressor set to have a cooling energy delivery rate at least capable of meeting the total energy requirement of the cooling load cycle when operated continuously for a time corresponding to that between the initiation of successive cooling cycles, sizing the cold storage bank to have a cooling energy storage capacity at least equal to the requirement of the cooling load cycle less the product of the delivery rate of the prime mover compressor set times the duration of the cooling load cycle, connecting the output of the prime mover compressor set and the ice bank to the load, operating the prime mover compressor set substantially throughout the period between successive cooling cycles and through the peak cooling load cycle and supplementing any shortfall of cooling energy being delivered from the prime mover compressor set to the load on a real time basis with cooling energy previously produced by the prime mover compressor set and stored in the ice bank.

2. A method as set forth in claim 1, wherein the prime mover compressor set is provided with a variable operational speed and cooling energy output capacity and the speed of the prime mover compressor set is modulated within its operational limits to attempt equalization of cooling energy delivered by the prime mover compressor set and contemporaneous load whereby consumption or production of stored cooling energy is minimized.

3. A method as set forth in claim 1, wherein the refrigeration circuit is provided with an evaporator and a condenser, the prime mover compressor set circulates refrigerant between the evaporator and condenser, the condenser being arranged to transfer heat to the earth's atmosphere, the refrigeration circuit being arranged to operate the condenser at one temperature during midday hours and being reset to operate the condenser at a substantially lower temperature during those evening hours when production of stored cooling energy is underway.

4. A method as set forth in claim 1, wherein the prime mover compressor set is operated simultaneously to the existence of a heat load, the heat rejected by the fuel-fired prime mover being used to contribute to the heat load.

5. A method as set forth in claim 4, wherein the heat load is given priority for operation of the prime mover compressor set over simultaneous production of cooling energy with cooling load.

6. A method of meeting a cyclic daily cooling load comprising providing a refrigeration circuit with a power-operated compressor connected to an evaporator and a condenser, a cold storage ice bank, the condenser being arranged to transfer heat to the earth's atmosphere, the evaporator and cold storage bank being inter-connected to one another and to a zone to be cooled, during daytime periods of relatively high cooling load at the zone and simultaneous operation of the compressor maintaining the condenser at a first predetermined temperature, and during nighttime periods of operation of the compressor when charging the ice bank maintaining the condenser at a second predetermined temperature substantially lower than said first temperature whereby efficiency of operation is improved at nightime by a reduction in energy required to transfer heat between the evaporator and condenser.

7. A refrigeration system comprising a heat engine, a refrigeration compressor directly mechanically coupled to a driven by the engine, a refrigeration circuit including a condenser and evaporator, a cold storage bank, means connecting the evaporator to the cold storage bank, a cooling load exhibiting cyclic peaks, means for producing heat exchange between the cold bank and cooling load, the cold bank having sufficient thermal capacity to satisfy at least a major portion of the cooling requirements of the cooling load, the rated maximum capacity of the compressor being sized to provide only a fraction of the peak cooling demand so that a design cooling load to compressor capacity ratio of about 1.6:1 or greater exists, the cold storage bank being arranged to deliver a cooling rate substantially equal to that of the cooling load less the output of the compressor, if any, during times of greatest cooling demand.

* * * * *